US005769492A

United States Patent [19]

Jensen

[11] Patent Number: 5,769,492

[45] Date of Patent: Jun. 23, 1998

[54] BACK SAVER SPORT SEAT

[76] Inventor: Robert J. Jensen, 611 NE. 2nd Ave., Stewartville, Minn. 55976

[21] Appl. No.: 763,197

[22] Filed: Dec. 10, 1996

[51] Int. Cl.[6] ..... A47C 1/02

[52] U.S. Cl. ..... 297/314; 297/188.09

[58] Field of Search ..... 297/314, 337, 297/313, 188.08, 188.09, 256.16, 258.1, 188.1, 188.12, 188.11, 188.13

[56] References Cited

U.S. PATENT DOCUMENTS 975,827 11/1910 Busch .
2,799,323 7/1957 Berg .
4,552,404 11/1985 Congleton ..... 297/330
4,846,076 7/1989 Menges, Sr. et al. .
5,024,485 6/1991 Berg et al. .
5,577,803 11/1996 Guilbaud .
5,588,704 12/1996 Harza .

FOREIGN PATENT DOCUMENTS 2226838 12/1972 Germany .

*Primary Examiner*—Milton Nelson, Jr.
*Attorney, Agent, or Firm*—Schwegman, Lundberg, Woessner & Kluth, P.A.

[57] ABSTRACT

An apparatus for supporting a user in a seated position is disclosed. The apparatus includes a seat for supporting the user in a seated position, and a base. A connection mechanism couples the seat to the base in such a way as to allow undulatory movement of the seat relative to the base in response to motions of the user's spine to thereby reduce the total spinal movement of the user's spine.

13 Claims, 7 Drawing Sheets

BACK SAVER SPORT SEAT

BACKGROUND OF THE INVENTION

The present invention is directed to a device which provides a user more free and complete spinal movement while the user is seated. Specifically, the present invention is directed to a device suitable for use as a seat wherein operation of the device with a user seated thereon allows more freedom and complete spinal movement in the following motions and combinations thereof: flexion, extension, rotation and lateral flexion.

It is well known that the biomechanics of the spine allow the body to accommodate numerous primary ranges of motion (flexion, extension—right and left, rotation—right and left, lateral bending, as well as long-axis distraction and compression or load/unload cycles). In conventional seating apparatus, motion and/or static position by the user that results in one or more of these spinal movements causes the user's spine and associated soft tissues to absorb the entire motion and stresses associated therewith. Static spinal positioning or inadequate seat mobility causes a build-up of spinal irritation, soft tissue pressure, muscle spasm or loss of tone as well as circulatory disturbance in the spinal soft tissues resulting in significant stress on the user's spine. Without the ability to compensate for and/or produce these essential movements, the user will frequently experience backaches and eventual spinal pathology after prolonged static sitting.

SUMMARY OF THE INVENTION

The present invention is directed to an apparatus for supporting a user in a seated position. The apparatus includes a seat, a base, and a connection mechanism which couples the seat to the base. The connection mechanism couples the seat to the base in such a way as to allow free (non-resistant) undulatory movement of the seat relative to the base to thereby compensate for spinal movement of the user. It also allows for continuous, even weight distribution on the right and left ischial tuberosity, preventing undue pressure build-up in the spine and associated soft tissues.

In preferred embodiments, the connection mechanism includes an elongated connecting member having a first end coupled to the seat and a second end coupled to the base. The connecting member can be either a rigid connecting member such as a bolt, or a flexible connecting member. If a rigid connecting member is used, the connecting member is coupled to at least one of the seat and the base in a non-rigid manner to thereby allow undulatory movement of the seat relative to the base while supporting the user and the seat at a position above the base. The connection mechanism also includes first and second discs which are positioned between the seat and the base. The connecting member extends through apertures in the first and second discs. A first pad or spacer is positioned between the first and second discs, and the connecting member extends through an aperture in the first pad. The aperture in the first pad is larger than a cross-sectional area of the connecting member to thereby allow undulatory movement of the first pad relative to the base. Movement of a user causing curvature of the user's spine in a first direction results in movement of the seat and of the first pad relative to the base such that the connection mechanism of the apparatus exhibits or approximates a curvature generally in the first direction as well. In this manner, the total curvature of the user's spine caused by movement of the user is reduced.

DETAILED DESCRIPTION OF THE PREFERRED EMBODIMENTS

Figure 1:
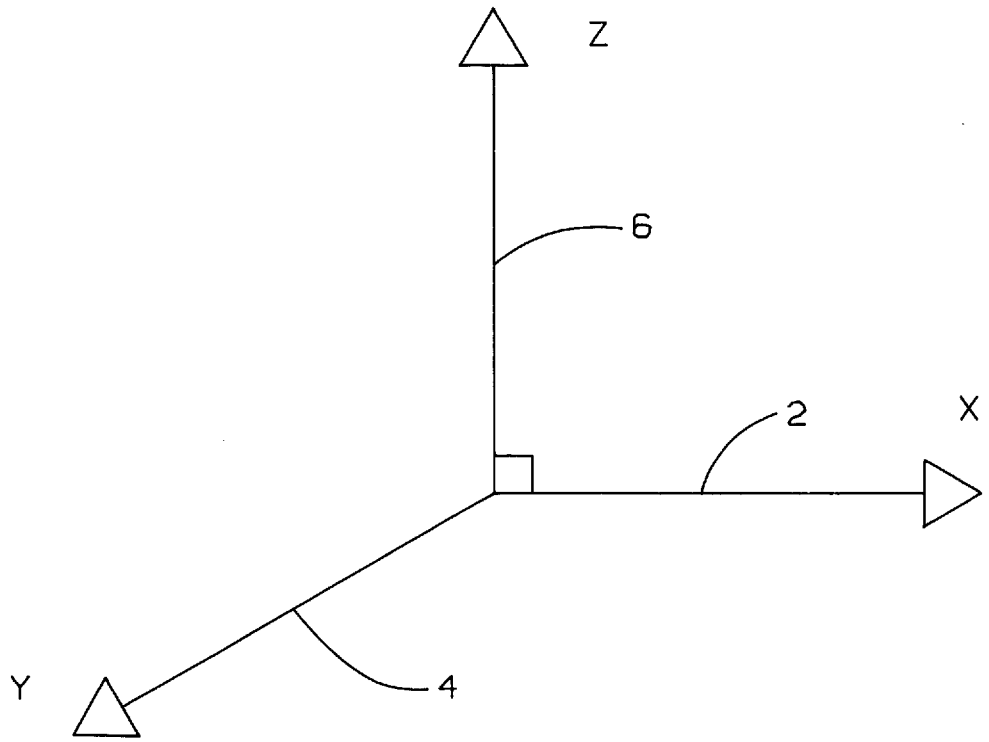
FIG. 1 is an illustration of a coordinate system, having three orthogonal axes, which is used to describe aspects of the present invention.

FIG. 1 is a right-handed coordinate system which is used to described certain aspects and features of the seating apparatus of the present invention. The coordinate system illustrated in FIG. 1 has three axes: pitch axis 2 (the x axis), roll axis 4 (the y axis), and yaw axis 6 (the z axis). As used in this application, axes 2 and 4 form a plane which is representative of planes which are substantially parallel to the ground. As will be discussed later in greater detail, certain components of the seating apparatus of the present invention lie in planes that are generally parallel to the plane defined by axes 2 and 4. Also as used herein, terms such as "up", "upward" and "on top of" are intended to represent the positive z direction, while terms such as "down", "downward" and "below" are intended to represent the negative z direction.

The undulatory motion allowed by the seating apparatus of the present invention is described with reference to FIG. 1. Simply put, a seat portion of the apparatus is allowed to rotate about two orthogonal axes, otherwise known as the pitch and roll axes, 2 and 4, respectively. Actual movement of the seat portion of the apparatus will be in a direction dependent upon the direction of the user's spinal movement or curvature. Also, in some embodiments, rotation of the seat portion of the apparatus of the present invention about yaw axis 6 is provided.

Figure 2:
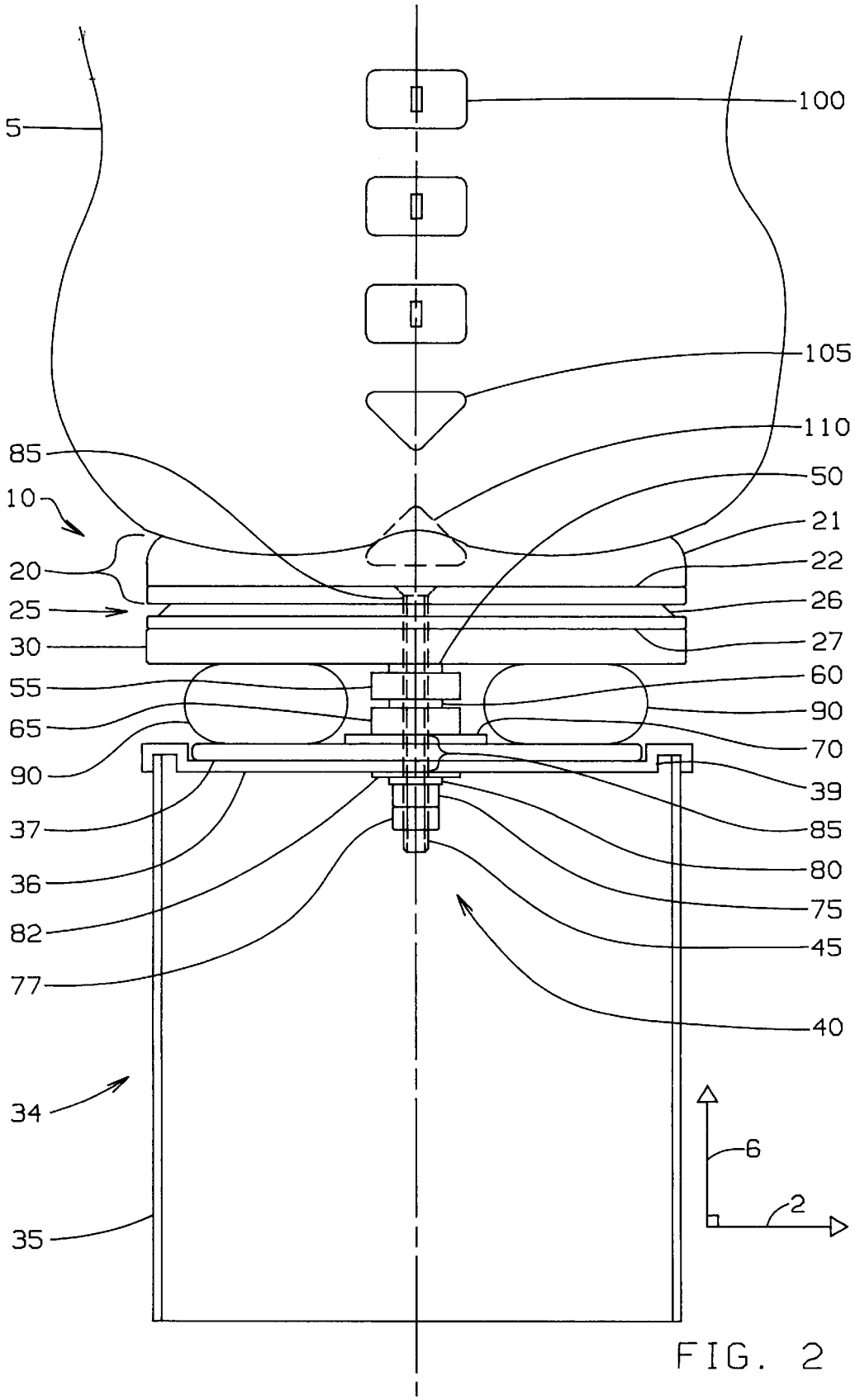
FIG. 2 is a diagrammatic rear view illustrating preferred features of the seating apparatus of the present invention.

FIG. 2 illustrates a rear diagrammatic view of seating apparatus 10 in accordance with some preferred embodiments of the present invention. Seating apparatus 10 allows user 15 more free and complete spinal movement from the seated position in the following motions and combinations thereof: flexion, extension, rotation and lateral flexion. Apparatus 10 allows user 15 to move reflexively and innately when pressure, irritation, muscle spasms and/or loss of tone in any of the spinal soft tissues dictate that necessity —thus allowing a spontaneous correction of position almost without thought or effort.

Seating apparatus 10 includes seat 20, lazy susan bearing 25, support 30, base 34, connection mechanism 40 and foam washer 90. Seat 20 includes padded portion 21 and first support 22, with padded portion 21 secured to support portion 22. Support 22 can be any of a variety of substantially rigid materials such as wood, plastic or metal.

In optional embodiments in which apparatus 10 includes lazy susan bearing 25, second support portion 30 is also included below first support 22. Second support 30 can be of the same materials and have a similar planar shape as first support 22. In these embodiments, top plate 26 of lazy susan bearing 25 is positioned adjacent and coupled to first support 22. Bottom plate 27 of lazy susan bearing 25 is positioned adjacent and coupled to second support 30. In this manner, seat 20 and top plate 26 can rotate with respect to support 30 and bottom plate 27 about an axis extending substantially parallel to axis 6 of the coordinate system illustrated in FIG. 1. In general, padded portion 21, first support 22, lazy susan bearing 25, and second support 30 can all be considered elements of the seat portion of apparatus 10 of the present invention. However, it must be noted that one or more of these components, such as lazy susan bearing 25 and bottom support 30, can be omitted in other embodiments.

While base 34 can take a variety of forms, in preferred embodiments it includes bucket 35, lid 36 and support 37. Lid 36 covers upward facing open end 38 of bucket 35. Support 37, which is preferably a solid material such as wood, plastic or metal formed to fit within recess 39 of lid 36 sits atop lid 36 in the recessed area. While bucket 35, lid 36 and support 37 are a preferred embodiment for base 34 because of the simplicity of such a configuration, base 34 can take on a wide variety of other configurations and can use other materials.

Connection mechanism 40 includes elongated or longitudinally extending connecting member 45, first disc 50, first pad or spacer 55, second disc 60, second pad or spacer 65, third disc 70, nuts 75 and 77, lock washer 80 and washer 82. Connecting member 45 is preferably a bolt or other rigid connecting device having a threaded end. However, in other embodiments, connecting member 45 is made from a slightly flexible material to help allow undulatory motion of seat 20 to thereby compensate for spinal motions of the user. Discs 50, 60 and 70 and pads 55 and 65 are preferably made of a solid material such as metal, plastic or wood, or from a flexible material such as rubber. Preferably, the discs and pads will have a cylindrical shape and will at least partially imitate the function and structure of spine 100 of user 15. First disc 50 is positioned adjacent support 30, while third disc 70 is preferably positioned adjacent support 37. Second disc 60 is preferably positioned between first disc 50 and third disc 70. Pad 55 is preferably positioned between disc 60 and disc 50, while pad 65 is preferably positioned between disc 60 and disc 70.

A series of apertures 85 extend through each of support 22, plates 26 and 27 of lazy susan bearing 25, support 30, disc 50, pad 55, disc 60, pad 65, disc 70, support 37, and lid 36. Apertures 85 extending through each of these components are substantially aligned to create one continuous aperture extending from support 22 through lid 36. Preferably, a width, diameter or area of aperture 85 is sufficiently larger than a cross-sectional area of connecting member 45 to allow undulatory motion of seat 20 relative to base 34 (i.e., support 37) or to the ground. Also washer 82 and lock washer 80 are loosely secured against the downward facing side of lid 36 by nuts 75 and 77 in order to couple connecting member 45 and connection mechanism 40 to base 34 to thereby support seat 20 and user 15 above base 34. By loosely attaching nuts 75 and 77 on the threaded end of connecting member 45, connecting member 45 can more easily move within aperture 85, which has a shape and area sufficient to allow at least some movement of the connecting member in the direction of axes 2 and 4, to facilitate the undulatory motion desired.

As user 15 sits on seating apparatus 10, with sacrum 105 positioned substantially directly above an axis defined generally by connecting member 45, spinal movements (i.e., flexion, extension, rotation, lateral flexion and combinations thereof) of lumbar spine 100 are made more freely. It is noted that sacrum 105 can be considered to be the immovable portion of the spine. If seat 20 is visualized as the base of an inverted sacrum 110 (shown for illustrative purposes only), the segmental movement of discs 50, 60 and 70 and pads 55 and 65 beneath the seat approximately duplicate the motion of spine 100 of the user above the seat. This is illustrated further in FIGS. 3 and 4.

Washer 90 is preferably made from foam, rubber or other deformable material. Washer 90 is preferably formed generally in the shape of a donut such that, when placed between support 30 and support 37, it surrounds connection mechanism 40. Washer 90 helps to dampen movements of seat 20 relative to base 34, while still allowing at least partial movements of the types discussed above. A variety of alternative embodiments are possible without departing from the scope of the invention. For example, bearing 25 can be eliminated and rotation can be allowed to take place between support 30 and support 37 through cumulative rotation on components 50, 55, 60 and 65.

Figure 3:
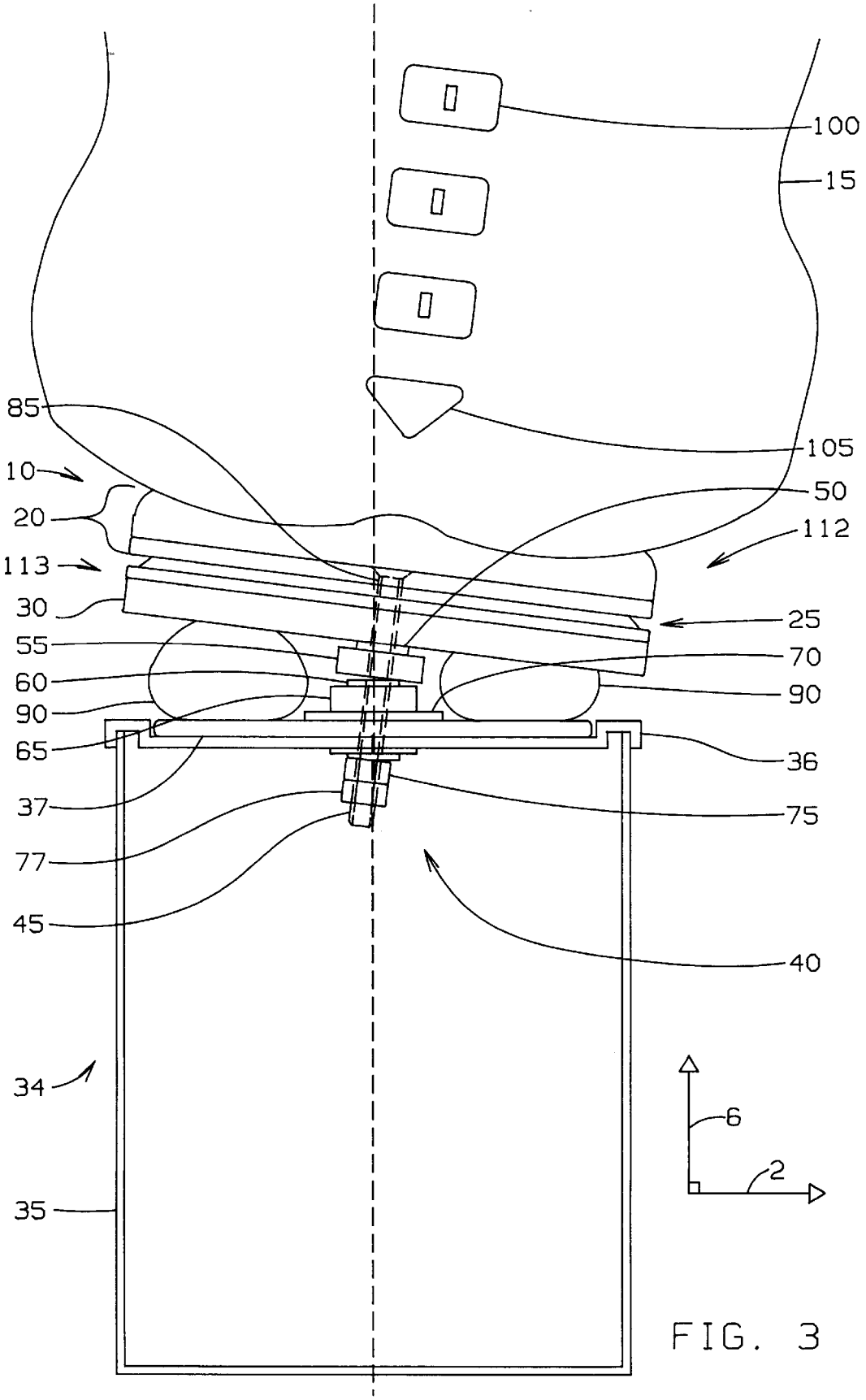
FIG. 3 is a diagrammatic rear view of the seating apparatus shown in FIG. 2, which further illustrates operation of the apparatus in response to spinal movement of user.
Figure 4:
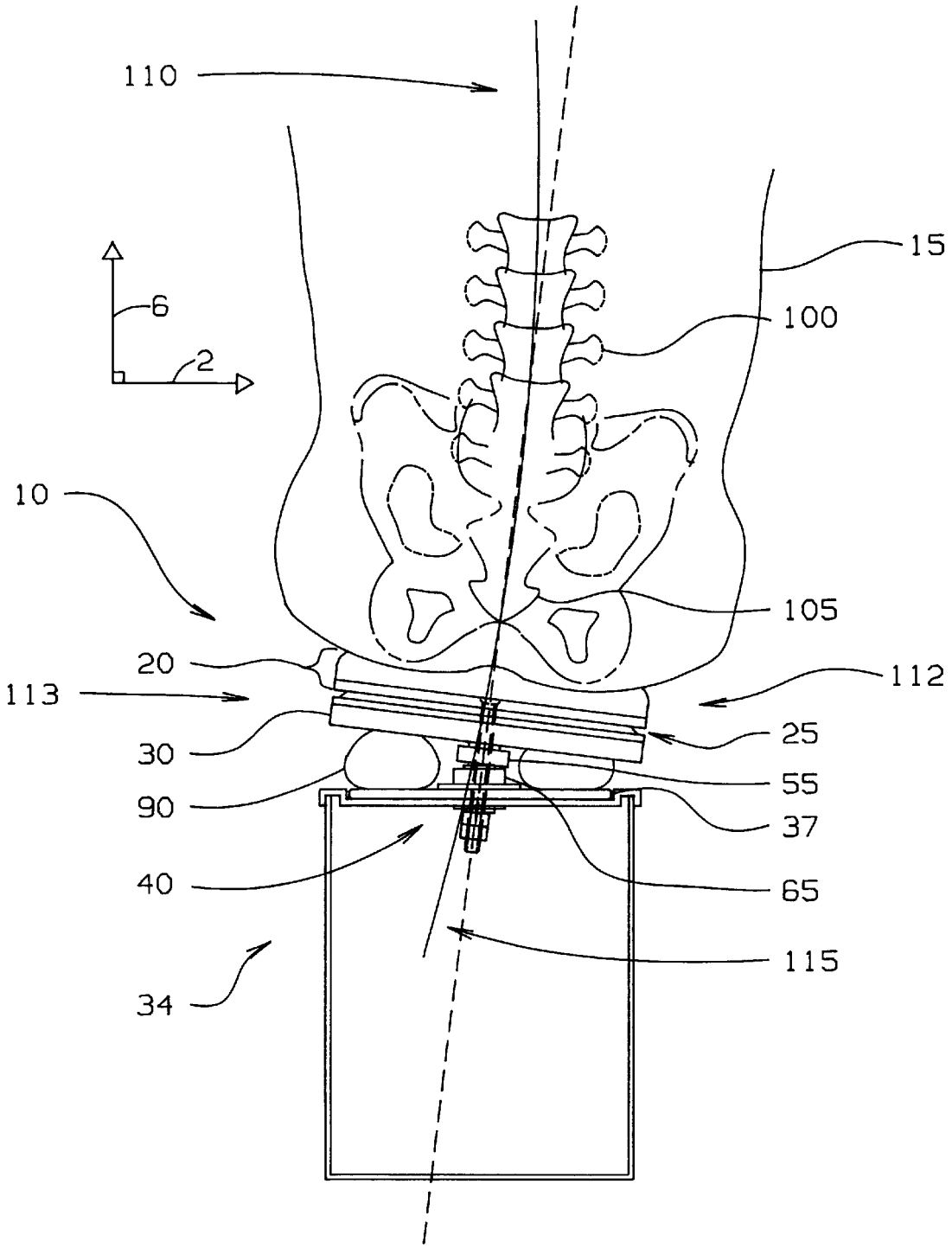
FIG. 4 is a diagrammatic rear view similar to FIG. 3, but illustrating the function of the seating apparatus of the present invention in response to spinal motion by the user in greater detail.

FIGS. 3 and 4 are rear diagrammatic views of seating apparatus 10 which illustrates the manner in which apparatus 10 duplicates the motion of the user's spine in order to reduce the total spinal movement. As illustrated in FIGS. 3 and 4, spine 100 of user 15 is exhibiting a lateral flexion movement which produces a generally concave left spinal curvature. The curvature accommodation of spine 100 as illustrated in FIG. 4 is indicated generally at 110. While a concave left lateral flexion spinal movement is illustrated, seating apparatus 10 of the present invention allows undulatory movement in order to accommodate any combination of flexion, extension, rotation, and lateral flexion spinal movements.

As illustrated in FIGS. 3 and 4, with spine 100 exhibiting a generally concave left curvature 110, seat 20, lazy susan bearing 25 and support 30 tilt such that side 112 is closer to the ground or to base 34 than is side 113. At side 112 of apparatus 10, washer 90 compresses to absorb a portion of the force and to prevent support 30 from coming into contact with lid 36 or support 37. Because aperture 85 is larger than the size of connecting member 45, member 45 moves within aperture 85 in response to the spinal motion. This in turn causes pad 55 to rotate relative to disc 60, thus allowing connection mechanism 40 to form curvature 115. Like curvature 110 of spine 100, curvature 115 of mechanism 40 is generally concave left as illustrated.

A primary advantage of the invention relates to the fact that apparatus 10 allows approximately the same motion beneath the seat in mechanism 40 as occurs naturally in spine 100 and associated soft tissues above seat 20. Thus, it allows a compromise or reduction in spine motion by forcing mechanism 40 to absorb approximately equal parts of the total spinal motion (i.e., of the above-mentioned possible combinations of spinal movements). As can be seen in FIGS. 3 and 4, the segmental movement of the discs and pads beneath the seat approximately duplicates the motion of spine 100 above the seat. Thus, apparatus 10 allows user 15 to move reflexively and innately when pressure, irritation, muscle spasm or loss of tone in any of the spinal soft tissue dictates that necessity through the sensory nervous system to the brain. Consequently, spontaneous correction of spinal position is provided with less effort and generally without thought.

Figure 5:
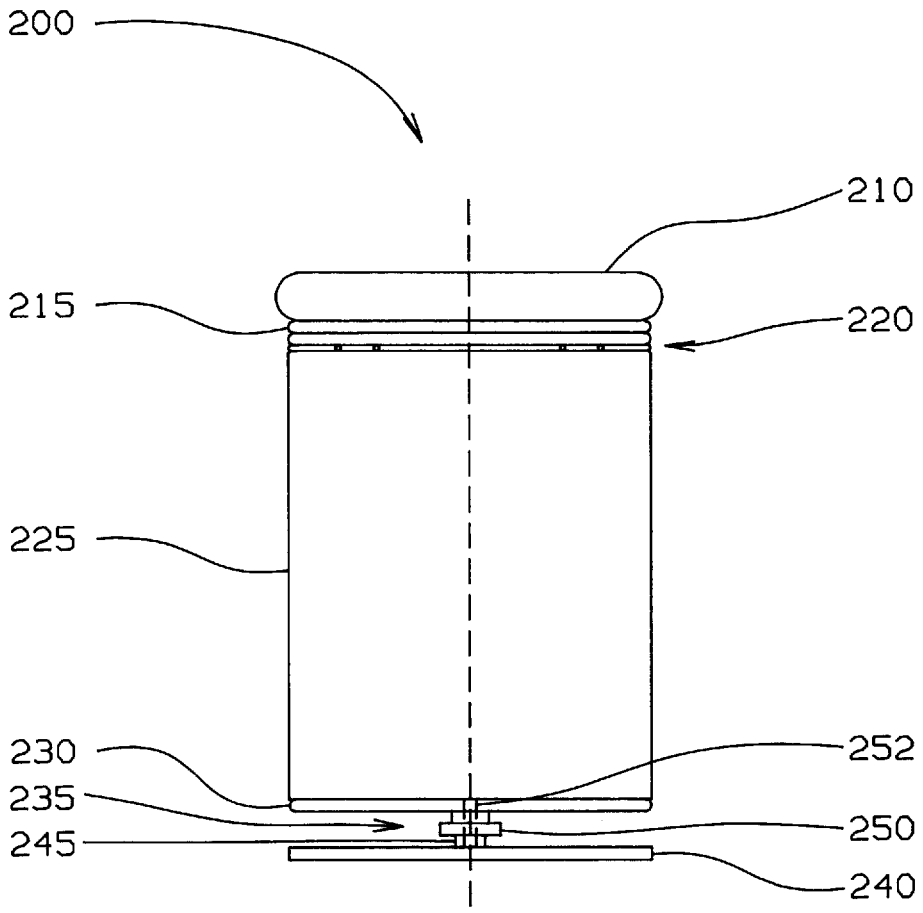
FIG. 5 is a diagrammatic rear view illustrating an alternate embodiment of the seating apparatus illustrated in FIG. 2 in accordance with other preferred embodiments of the present invention.

FIG. 5 illustrates an alternate embodiment of the seating apparatus first shown in FIG. 2. Seating apparatus 200 illustrated in FIG. 5 includes seat pad 210 fixedly attached to support 215. Support 215 can be any of a variety of support materials including plywood, plastic and metal. Between support 215 and bucket 225 is lazy susan bearing 220 which allows rotation of seat pad 210 and support 215 relative to bucket 225. An option to this is to simply eliminate bearing 220 allowing rotation to take place between support 230 and base 240 through cumulative rotation on components 245 and 250. At its lower end, bucket 225 is attached to support 230, which can be plywood for example. Base 240, which can also be a planer sheet of plywood, plastic or metal is adapted for resting on the ground to support the remainder of seating apparatus 200. Connection mechanism 235 is coupled between support 230 and base 240 in order to support the user while allowing free undulatory motion of the seat pad relative to base 240. Connection mechanism 235 functions substantially the same as connection mechanism 40 discussed above with reference to FIGS. 2–4. Like connection mechanism 40, connection mechanism 235 includes one or more discs 245 and one or more pads 250. A connective member 252, such as a bolt, extends through apertures in the one or more discs and pools. Thus, seating apparatus 200 functions substantially the same as seating apparatus 10 with the exception that the connection mechanism is in a location such that the bucket also exhibits undulatory motion in response to curvature of the users spine. Therefore, total spinal movement of a user of seating apparatus 200 is increased relative to the first described mechanism because of the long lever effect.

Figure 6:
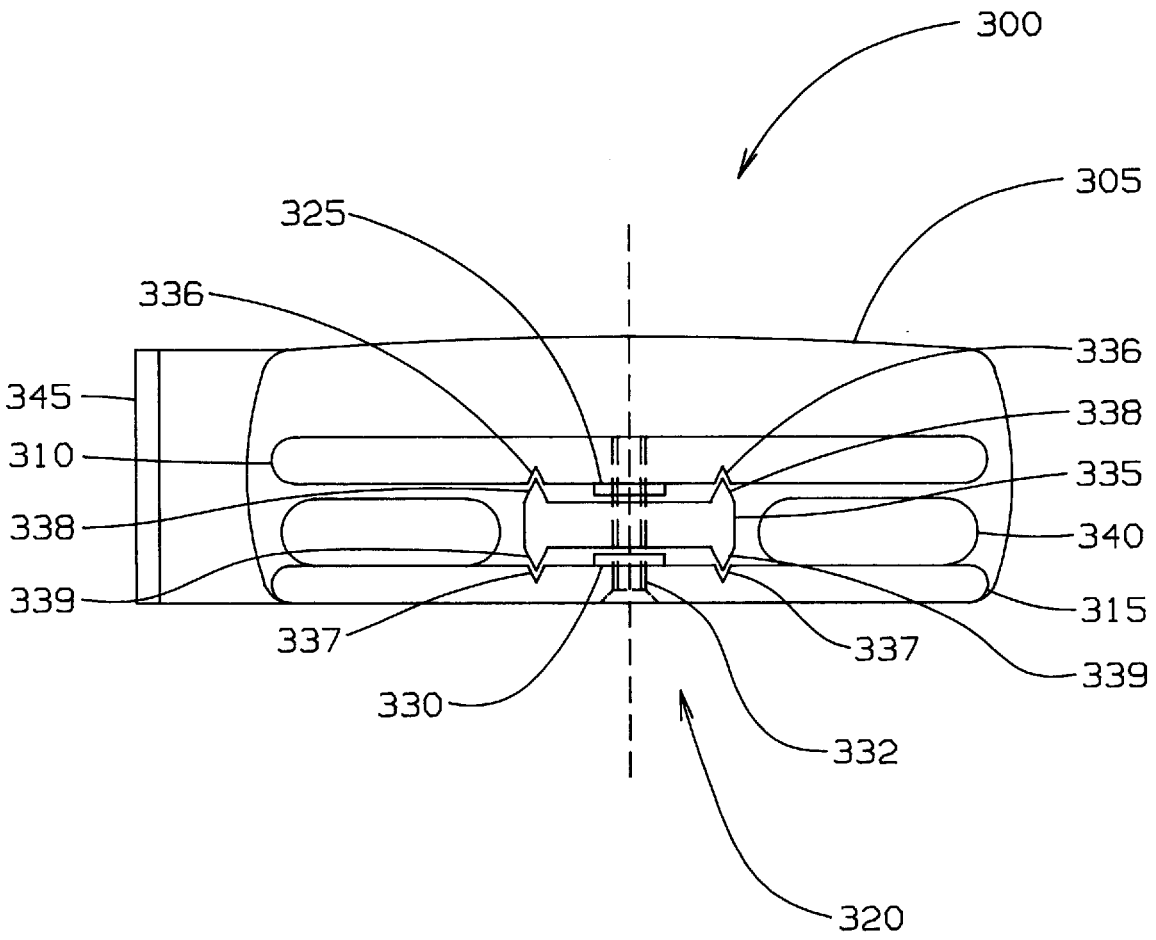
FIG. 6 is a diagrammatic rear view of an embodiment of a seating apparatus in accordance with the present invention for use with stadium and/or bleacher type seating.

FIG. 6 illustrates an embodiment of the seating apparatus of the present invention which is particularly adapted for use with stadium or bleacher seating. Seating apparatus 300 includes cushion 305 which is attached to support 310. Support 310 is coupled through connection mechanism 320 to base 315. Handle 345 is optionally coupled to base 315, support 310 and/or cushion 305 for carrying apertures 300 into a sporting event. Support 310 and base 315 can be made from any of a variety of materials including plywood, plastic and metal.

Like the seating apparatus discussed above, connection mechanism 320 of seating apparatus 300 includes one or more discs 325 and 330 and a connection member 332 extending therethrough. However, in seating apparatus 300, connection mechanism 320 also includes toothed spacer 335. Toothed spacer 335 includes annular tooth 338 extending circumferentially about its upper end, and annular tooth 339 extending circumferentially about its bottom surface. Support 310 includes annular guide 336, while base 315 includes annular guide 337. Annular guide 336 is positioned adjacent annular tooth 338 of spacer 335, while annular guide 337 is positioned adjacent annular tooth 339. With connection mechanism 320 functioning substantially the same as connection mechanism 40 discussed above with reference to FIGS. 2–4, the teeth of spacer of 335 are received into the corresponding portions of guides 336 and 337 during undulatory motion of seating apparatus 300. This aids in supporting the user when curvature of the user's spine causes undulatory motion of seating apparatus 300. Also, foam washer or shock absorber 340 helps to provide support during undulatory movement.

Figure 7:
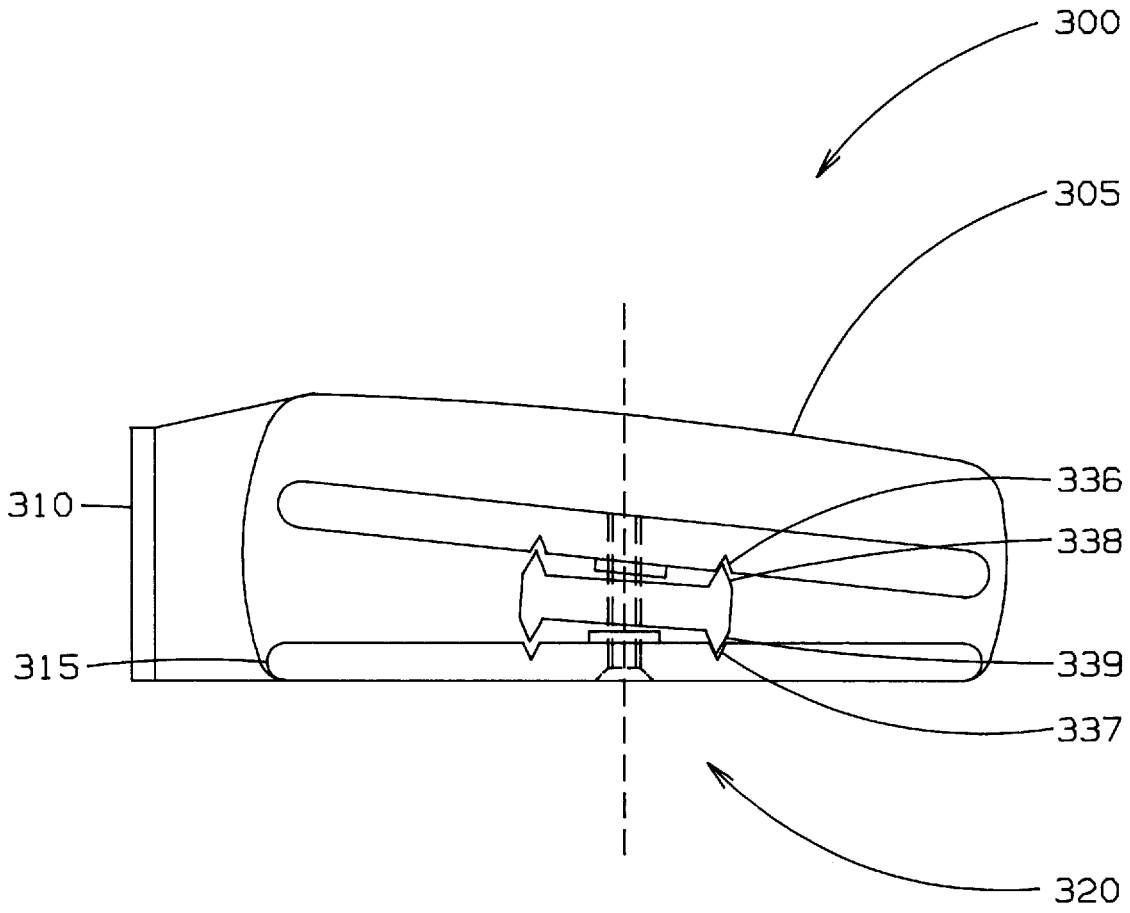
FIG. 7 is a diagrammatic rear view of the seating apparatus of FIG. 6 which illustrates the manner in which the seating apparatus allows free undulatory movement.

FIG. 7 illustrates the operation of seating apparatus 300 in response to movement of the user which causes curvature of a user's spine in the first direction. In order to reduce the total curvature of the user's spine, improve soft tissue tone and ultimately reduce pain and pathological changes in the user's spine, connection mechanism 320 imitates the curvature of the user's spine, while dispensing the user's seated weight more evenly on both ischial tuberosities rather than one, as is the case when the user is seated on a non-moving flat plane while attempting to move in various directions. In this motion, the corresponding portions of tooth 338 are received into the corresponding portions of guide 336, while the corresponding portions of tooth 339 are received into corresponding portions of guide 337. With connection mechanism 320 allowing free undulatory motion of seating apparatus 300 in response to movement of the user's spine, the total spinal motion of the user is reduced.

Although the present invention has been described with reference to preferred embodiments, workers skilled in the art will recognize that changes may be made in form and detail without departing from the spirit and scope of the invention.

What is claimed is:

1. An apparatus for supporting a user in a seated position, the apparatus comprising:

a seat for supporting the user in the seated position;

a base; and a connection mechanism coupling the seat to the base and allowing undulatory movement of the seat relative to the base, wherein the connection mechanism comprises:

an elongated connecting member having a first end coupled to the seat and a second end coupled to the base, the connecting member supporting the user and the seat at a position above the base, wherein the connecting member is coupled to at least one of the seat and the base in a non-rigid manner to thereby allow undulatory movement of the seat relative to the base;

a first disc positioned between the seat and the base and having a first aperture extending therethrough, wherein the connecting member extends through the first aperture;

a second disc positioned between the seat and the base and having a second aperture extending therethrough, wherein the connecting member extends through the second aperture; and a first pad positioned between the first disc and second disc having a third aperture extending therethrough, wherein the connecting member extends through the third aperture, the third aperture having an area larger than a cross sectional area of the connecting member and thereby allowing undulatory movement of the first pad about the connecting member relative to the base.

2. The apparatus of claim 1, wherein the connecting member is a rigid elongated connecting member.

3. The apparatus of claim 1, wherein the connecting member is a flexible elongated connecting member.

4. The apparatus of claim 1, wherein the base comprises:

a bucket;

a lid positioned on top of the bucket; and a support positioned on top of the lid, wherein the second end of the connecting member is threaded and extends through apertures in the support and in the lid, wherein the connecting member is coupled to the support and to the lid using a first nut which cooperates with the threaded second end of the connecting member to allow the connecting member to move within the apertures in the support and the lid.

5. The apparatus of claim 1, wherein movement of the user causing curvature of the user's spine in a first direction results in movement of the seat and of the first pad relative to the base such that the connection mechanism exhibits curvature generally in the first direction.

6. The apparatus of claim 5, wherein movement of the user causing curvature of the user's spine in the first direction results in movement of the seat and of the first pad relative to the base such that the connection mechanism exhibits curvature generally in the first direction to thereby reduce a total curvature of the user's spine caused by the movement of the user.

7. The apparatus of claim 1, wherein the connection mechanism further comprises:

a third disc positioned between the seat and the base and having a fourth aperture extending therethrough, wherein the connecting member extends through the fourth aperture; and a second pad positioned between the second disc and the third disc and having a fifth aperture extending therethrough, wherein the connecting member extends through the fifth aperture, the fifth aperture having an area larger than a cross sectional area of the connecting member and thereby allowing undulatory movement of the second pad about the connecting member relative to the base.

8. The apparatus of claim 7, wherein the seat comprises:

a first support portion coupled to the connecting member; and a padded portion attached to the first support portion.

9. The apparatus of claim 8, wherein the seat further comprises:

a second support portion having a sixth aperture extending therethrough, wherein the connecting member extends through the sixth aperture; and a lazy Susan bearing positioned between the second support portion and the first support portion, the lazy Susan bearing having a seventh aperture extending therethrough, wherein the connecting member extends through the seventh aperture, and wherein the lazy Susan bearing allows the padded portion and the first support portion to rotate generally about an axis of the connecting member relative to the second support portion and the base.

10. The apparatus of claim 1, and further comprising a compressible washer positioned between the seat and the base, the compressible washer having an opening extending therethrough, wherein the first and second discs and the first pad of the connection mechanism are positioned within the opening of the compressible washer when the compressible washer is positioned between the seat and the base.

11. The apparatus of claim 10, wherein the compressible washer comprises a foam material.

12. The apparatus of claim 10, wherein the compressible washer comprises a rubber material.

13. An apparatus for supporting a user in a seated position, the apparatus comprising:

a seat for supporting the user in the seated position;

a base; and a connection mechanism coupling the seat to the base and allowing undulatory movement of the seat relative to the base, wherein the connection mechanism comprises:

an elongated connecting member having a first end coupled to the seat and a second end coupled to the base, the connecting member supporting the user and the seat at a position above the base, wherein the connecting member is coupled to at least one of the seat and the base in a non-rigid manner;

a first disc positioned between the seat and the base and having a first aperture extending therethrough, wherein the connecting member extends through the first aperture;

a second disc positioned between the seat and the base and having a second aperture extending therethrough, wherein the connecting member extends through the second aperture; and a first pad positioned between the first disc and the second disc and having a third aperture extending therethrough, wherein the connecting member extends through the third aperture, the third aperture having an area larger than a cross sectional area of the connecting member.

* * * * *